US005628334A

United States Patent [19]

Edwards et al.

[11] Patent Number: 5,628,334

[45] Date of Patent: May 13, 1997

[54] DISHWASHER WITH FOOD PARTICLE MACERATOR AND MINCER

[75] Inventors: James M. Edwards; John E. Dries, both of Kinston, N.C.

[73] Assignee: White Consolidated Industries, Inc., Cleveland, Ohio

[21] Appl. No.: 428,556

[22] Filed: Apr. 25, 1995

[51] Int. Cl.[6] ..... A47L 15/42

[52] U.S. Cl. ..... 134/104.1; 134/104.4; 134/111; 134/115 G; 241/46.012

[58] Field of Search ..... 134/104.1, 104.4, 134/111, 115 G; 241/46.012

[56] References Cited

U.S. PATENT DOCUMENTS

| | | | |
|---|---|---|---|
| 2,421,064 | 5/1947 | Hilliker | 134/115 G X |
| 2,593,359 | 4/1952 | Strehlow et al. | 241/46.012 |
| 2,633,726 | 4/1953 | Rand . | |
| 2,676,759 | 4/1954 | Strehlow | 241/46.012 X |
| 2,677,389 | 5/1954 | Jisha et al. . | |
| 2,750,779 | 6/1956 | Whyte . | |
| 3,434,671 | 3/1969 | Cushing et al. | 241/46.012 |
| 4,038,103 | 7/1977 | Grunewald | 134/111 X |
| 4,150,679 | 4/1979 | Cushing et al. | 134/111 X |
| 4,168,715 | 9/1979 | Spiegal et al. | 134/111 X |
| 4,228,962 | 10/1980 | Dingler et al. | 241/46.012 |
| 4,319,599 | 3/1982 | Dingler et al. | 134/186 X |
| 4,347,861 | 9/1982 | Clearman et al. | 134/186 X |
| 4,350,306 | 9/1982 | Dingler et al. | 134/115 G X |
| 4,754,772 | 7/1988 | Nord et al. | 134/111 |
| 4,795,102 | 1/1989 | Jordan et al. . | |
| 4,848,382 | 7/1989 | Bertsch et al. | 134/111 |
| 4,969,479 | 11/1990 | Lagerstrand | 134/111 X |
| 4,998,548 | 3/1991 | Lagerstrand | 134/111 |
| 5,143,306 | 9/1992 | Nilsson | 241/46.012 |
| 5,499,640 | 3/1996 | Kirkland | 134/111 X |

FOREIGN PATENT DOCUMENTS

| | | | |
|---|---|---|---|
| 2556480 | 6/1977 | Germany | 134/104.1 |

*Primary Examiner*—Philip R. Coe

*Attorney, Agent, or Firm*—Pearne, Gordon, McCoy & Granger

[57] ABSTRACT

A dishwasher sump is divided into a collection chamber and a pump chamber by a filter. Food particles collect in the collection chamber while filtered wash liquid collects in the pump chamber. A pump has an inlet located in the pump chamber. The filtered wash liquid is recycled and sprayed on objects in the dishwasher by the pump. The impeller is driven by a shaft extending through the collection chamber and a wall separates the pump chamber from the collection chamber. Food particles in the collection chamber are minced by a rotating blade on the pump shaft. Balancing vanes on a rear face of the impeller prevent food particles and dirty water from flowing into the filtered liquid from the collection chamber. At the end of a wash cycle, the minced food particles are pumped to a drain with the wash liquid.

14 Claims, 3 Drawing Sheets

DISHWASHER WITH FOOD PARTICLE MACERATOR AND MINCER

BACKGROUND OF THE INVENTION

1. Field of the Invention

This invention relates generally to the field of dishwashers and specifically to a food particle collection chamber with a mincing blade therein.

2. Description of the Related Art

Dishwashers, particularly those used in domestic applications, have a wash chamber conventionally provided with a sump at a lower part of the wash chamber. Wash liquid sprayed on dishes and other objects in the wash chamber flows downwardly into the sump where the liquid collects. The liquid can flow through a filter so that food particles are retained in a collection chamber of the sump. Filtered wash liquid in the sump is recycled to be sprayed on the dishes or directed toward a drain. The food particles are eventually pumped to the drain with the wash liquid. Such dishwashers are shown, for example, in U.S. Pat. Nos. 4,038,103 to Grunewald, 4,319,599 to Dingler, 4,347,861 to Clearman, 4,754,772 to Nord, 4,969,479 and 4,998,548 both to Lagerstrand. Large food particles may remain in the collection chamber causing unwanted clogging or odors. Other types of waste handling in dishwashers are shown in U.S. Pat. Nos. 4,150,679 to Cushing et al., 4,168,715 to Spiegel et al., 4,228,962 to Dingler, 4,350,306 to Dingler et al. and 5,143,306 to Nilsson.

In some installations, separate pumps (a recycling pump and a drain pump) are used to direct the liquid to the appropriate locations. In other installations, a single pump may be used in conjunction with a valve system to direct the liquid to either the drain or the wash chamber. An example of this is shown in U.S. Pat. No. 4,848,382 to Bertsch, incorporated herein by reference.

It would be preferable to use a single uni-directional motor to reduce cost and complexity, and improve efficiency. Food particles and the material from the dishes should not be recycled and should not interfere with the flow of liquid to the dishes or to the drain. The food particles should be completely removed from the collection chamber. In addition, it is desirable to isolate the pump from the food and other material to prevent clogging or damage to the pump.

SUMMARY OF THE INVENTION

The present invention provides washer, particularly a dishwasher, having a wash chamber. The washer includes a sump having first and second sump chambers adapted to hold liquid from the wash chamber of the dishwasher. A pump is adapted to move liquid from the second sump chamber to the wash chamber for spraying the liquid on articles in the wash chamber. A movable blade disposed in the first sump chamber is adapted to mince particles in the first chamber. A filter separates the sump chambers so that liquid from the wash chamber flows from the first chamber to the second chamber through the filter thereby collecting the particles in the first chamber.

The first sump chamber is adapted for macerating the particles. The blade is adapted for continuous operation when the pump is operating. The blade is rotatable and disposed on a shaft of the pump. The blade has angled edges adapted for circulating fluid in the first sump chamber.

The invention also comprehends a method of washing articles. Steps include spraying wash liquid on the articles; collecting the wash liquid and particles in a collection chamber; recirculating the wash liquid onto the articles; mincing the particles in the collection chamber; and draining the particles and wash liquid from the collection chamber.

Additional steps include filtering the wash liquid to retain the particles in the collection chamber; and macerating the particles in the collection chamber. Mincing occurs continuously during the step of recirculating.

DESCRIPTION OF THE PREFERRED EMBODIMENTS

Figure 1:
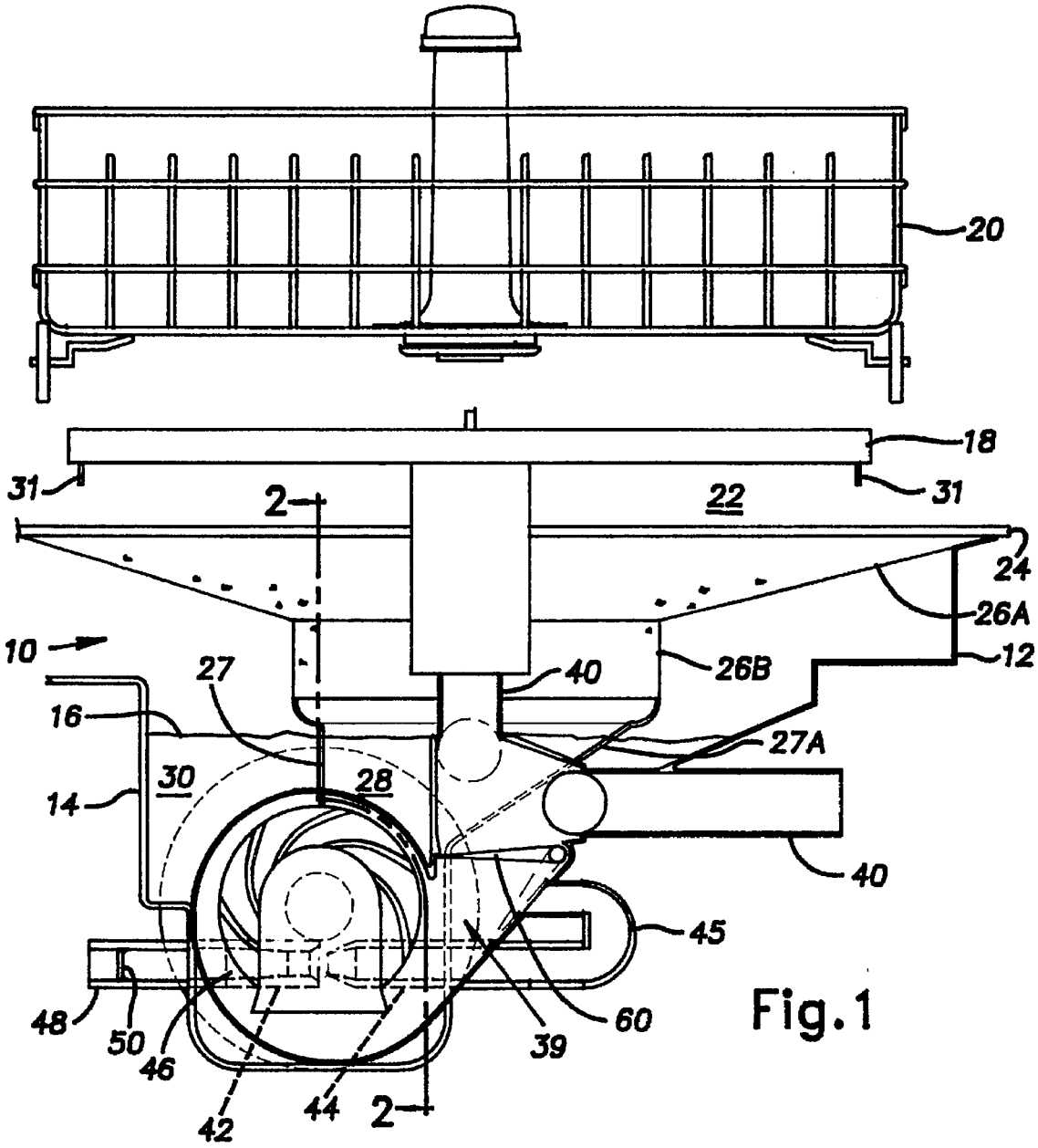
FIG. 1 is a partial elevational view of a dishwasher showing a sump, pump, and drain according to the invention.

Referring to FIG. 1, a dishwasher 10 includes a molded plastic tub 12 having a sump 14 molded therein. The sump 14 collects and holds wash liquid 16 that is sprayed from one or more spray arms 18 onto objects held in a rack 20 inside a wash chamber 22. The wash liquid 16 returns from the wash chamber 22 by force of gravity to the sump 14. A coarse filter 24, such as a grate, is disposed between the wash chamber 22 and the sump 14 to prevent flatware and other large objects from entering the sump 14. A fine filter 26 having a sloped, generally horizontal filter component 26A and an annular vertical filter component 26B is disposed in the sump 14 below the coarse filter 24. The fine filter 26 is preferably a molded mesh screen having 4 mm (0.015 in.) openings. An inner wall 27 of the sump 14 defines an extension of the fine filter 26 and separates the sump 14 into a first chamber, referred to as a collection chamber 28 or quiet chamber, and a second chamber, referred to as a pump chamber 30. The horizontal filter component 26A and a generally horizontal component 27A of the inner wall are sloped downwardly toward the collection chamber 28 to "funnel" food particles from the wash chamber 22 into the collection chamber. Wash liquid flows downwardly through the horizontal component 26A into the pump chamber 30. The fine filter 26 and inner wall 27 isolate the pump chamber 30 from the wash chamber 22 so that food particles and other material in the wash liquid are filtered out before the wash liquid enters the pump chamber 30. In one embodiment of the invention, the horizontal filter component 26A is located directly below the wash arm 18. The wash arm is then provided with a spray nozzle 31 adapted to direct wash liquid at the filter 26A and propel food particles toward the collection chamber 28. Other filter and wall arrangements that filter wash liquid and collect food particles in a chamber are also suitable for the present invention. Food particles are retained in the collection chamber 28 and macerated therein. When the liquid level is high enough, some of the wash liquid in the collection chamber 28 flows through the vertical component **26*b* into the pump chamber 30. In one embodiment of the invention, an additional component of the fine filter can be provided in the inner wall 27** at a lower part of the collection chamber to permit liquid flow from the bottom of the collection chamber into the pump chamber.

Figure 2:
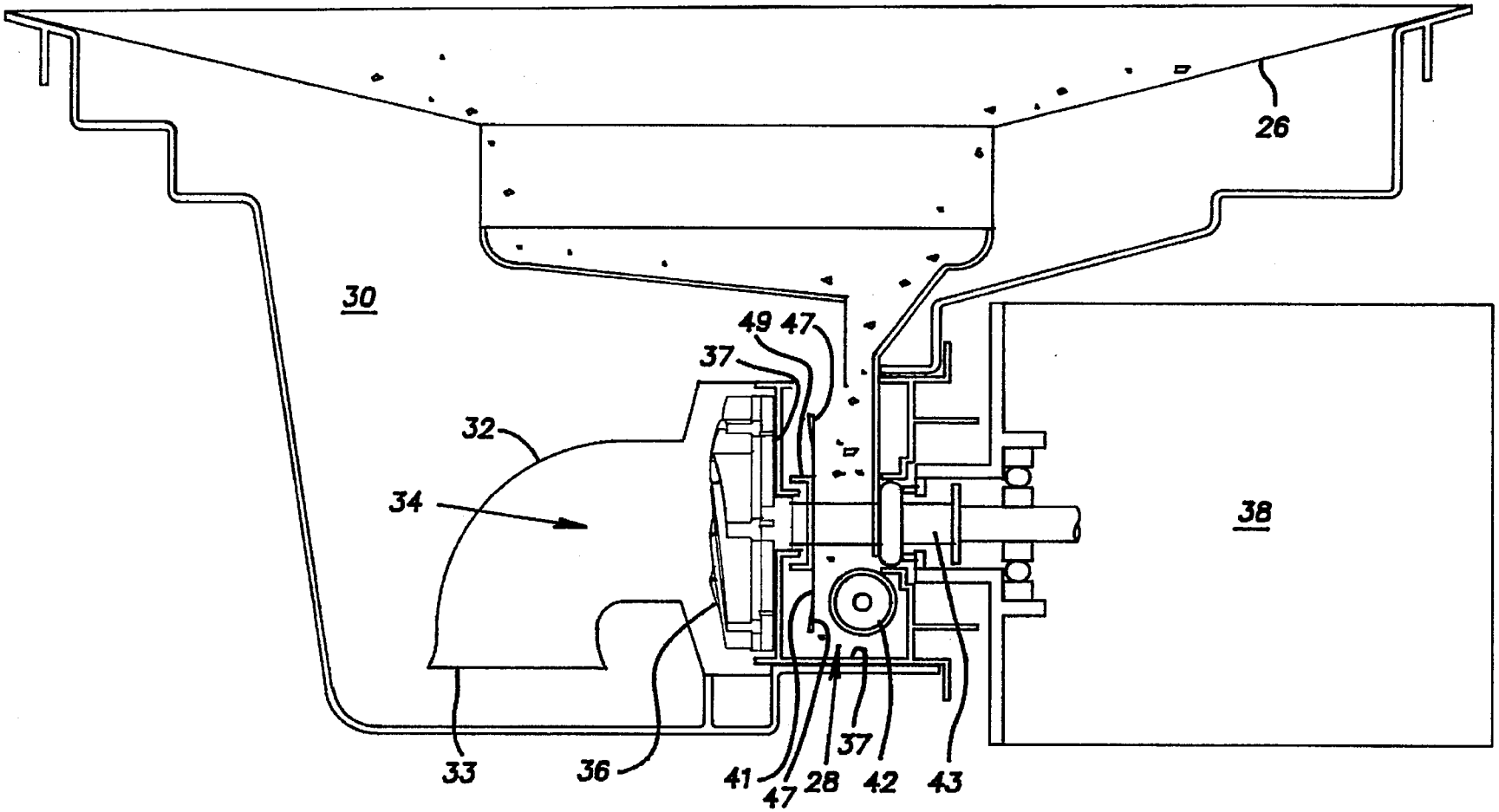
FIG. 2 is an elevational view in a section taken from line 2—2 of FIG. 1.

Referring to FIG. 2, the pump chamber 30 communicates with an inlet 32 of a pump 34 having an impeller 36 driven by a motor 38. A mouth 33 of the inlet 32 is substantially horizontal and disposed at or below the level of a bottom wall 37 of the collection chamber 28 to ensure complete discharge of liquid in the collection chamber. A mincing blade 41 is disposed on a shaft 43 driven by the motor 38. The blade 41 is made from a hard, corrosion resistant material, such as stainless steel or aluminum. The blade 41 has sharp edges 47 that chop the food particles in the collection chamber 28. The edges 47 can be angled slightly from the plane in which the blade 41 rotates for circulating liquid and food particles within the collection chamber 28 for more efficient mincing. The circulation created by the blade 41 and the rotation of the shaft 43 might cause some of the liquid to migrate or flow toward the pump 34 around the shaft. A seal, such as a labyrinth seal 49, and/or balancing vanes 37 on a rear face of the impeller 36 are adapted for preventing such migration or flow.

Referring to FIG. 1, an outlet 39 of the pump 34 is in communication with one or more conduits 40. The pump 34 moves wash liquid 16 from the pump chamber 30 through the conduit 40 to the spray arm 18. A venturi 42 has a inlet 44 in communication with the pump outlet 39 through a U-pipe 45. An outlet 46 of the venturi 42 communicates with a drain pipe 48 through a check valve 50. A diverter valve 60 operated by a solenoid (not shown) selectively connects the pump outlet 39 to the wash arm conduits 40 or the venturi 42.

Figure 3:
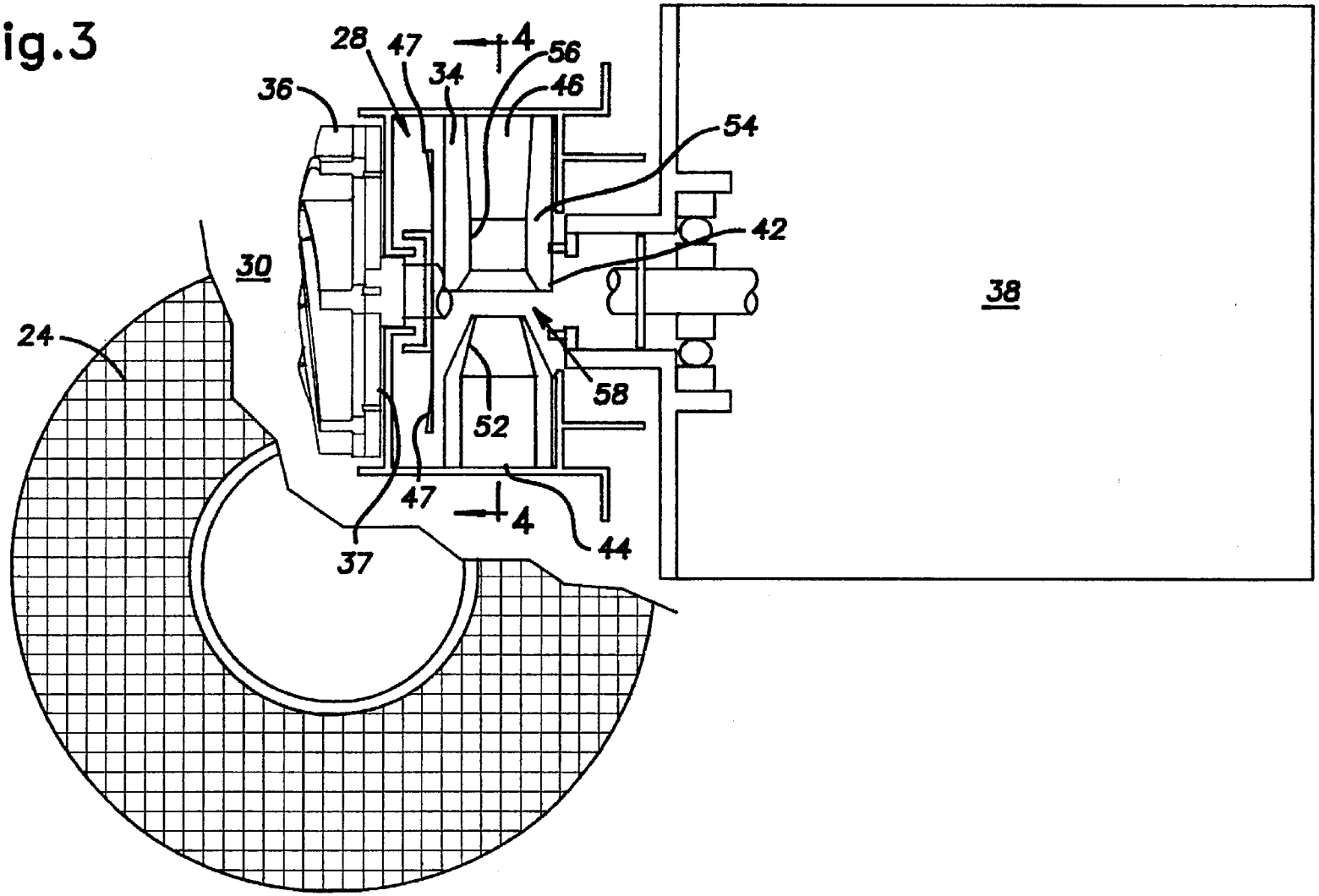
FIG. 3 shows a top view of the sump with part of a filter cutaway.

Referring to FIG. 3, the venturi 42 includes a nozzle 52 and a diffuser 54 defining a throat 56. A suction gap 58 between the nozzle 52 and the diffuser 54 communicates with the collection chamber 28. The venturi 42 is configured as an educator type jet pump. A relatively high pressure stream of wash liquid is directed through the nozzle 52, which is designed to develop a high velocity of liquid flow. The high velocity liquid creates a low pressure area in the diffuser 54 causing liquid and food particles from the collection chamber to flow into the diffuser 54 through the suction gap 58. In the diffuser, low velocity suction liquid from the collection chamber 28 mixes with the high velocity liquid. At the venturi outlet 46, the velocity of the mixed liquid reduces and the pressure increases.

During a wash operation, the diverter valve 60 is in a recirculate position (shown in phantom in FIG. 1). Wash liquid 16 from the pump chamber 30 is pumped through the conduit 40 and out of the spray arm 18 onto objects being washed. The wash liquid 16 flows down through the coarse filter 24 into the sump 14. Objects and large food particles are filtered by the coarse filter 24. The large food particles will eventually be eroded and dissolved until they pass through the coarse filter. The wash liquid continues flowing downwardly through the fine filter 26, which filters most of the food particles. The filtered wash liquid flows into the pump chamber 30, from where it is recirculated through the wash arm 18 by the pump 34. Food particles tend to move down the sloped horizontal component 26A of the fine filter 26 and the horizontal component 27A of the inner wall 27 toward the collection chamber 28. Wash liquid 16, containing food particles, that does not flow through the fine filter 26 flows into the collection chamber, where the food particles are collected. Wash liquid from the collection chamber 28 are filtered and flow into the pump chamber 30 or remain in the collection chamber 28. Food particles in the collection chamber 28 are macerated by the liquid and, when the motor 38 is operating, chopped or minced by the blade 41. The minced particles are later evacuated through the venturi 42, as described below, or by a drain pump, for example.

When the wash operation is completed, the solenoid moves the diverter valve 60 to a drain position (shown in solid lines in FIG. 1). The pump 34 forces wash liquid from the pump chamber 30 through the U-pipe 45 to the venturi 42. The flow of wash liquid through the venturi 42 entrains wash liquid in the collection chamber 28 through the suction gap 58. The entrained wash liquid carries food particles from the collection chamber 28 through the diffuser 54 to the drain pipe 48. Draining continues until the liquid level in the pump chamber 30 is below the pump mouth 33 and, preferably, the collection chamber 28 is substantially empty. Substantially all of the food particles in the collection chamber are thereby discharged from the dishwasher 10. The diverter valve 60 is returned to the recirculating position for a subsequent wash cycle.

The present disclosure describes several embodiments of the invention, however, the invention is not limited to these embodiments. Other variations are contemplated to be within the spirit and scope of the invention and appended claims.

What is claimed is:

1. A washer comprising:

a sump having a wall defining first and second sump chambers adapted to hold liquid from a wash chamber of the washer;

a pump having a shaft and adapted to move liquid from the second sump chamber to the wash chamber; and a movable blade disposed on the shaft, in the first sump chamber, and adapted to mince particles in the first chamber wherein the wall collects minced particles in the first chamber.

2. A washer according to claim 1 wherein the wall includes a filter separating the sump chambers so that liquid from the wash chamber flows from the first chamber to the second chamber through the filter thereby collecting the particles in the first chamber.

3. A washer according to claim 1 wherein the first sump chamber is adapted for macerating the particles.

4. A washer according to claim 1 wherein the blade is adapted for continuous operation when the pump is operating.

5. A washer according to claim 1 wherein the blade is rotatable.

6. A washer according to claim 1 wherein the blade has angled edges adapted for circulating fluid in the first sump chamber.

7. A washer according to claim 1 further comprising a venturi for emptying the first chamber.

8. A washer comprising:

a wash chamber adapted for containing articles to be washed;

a sump of the wash chamber having a wall defining first and second sump chambers adapted to hold liquid from the wash chamber;

a pump having a shaft and adapted to move liquid from the second sump chamber to the wash chamber to be sprayed on the articles; and a movable blade disposed on the shaft, in the first sump chamber, and adapted to mince particles in the first chamber wherein the wall collects minced particles in the first chamber.

9. A washer according to claim 8 wherein the wall includes a filter separating the sump chambers so that liquid from the wash chamber flows from the first chamber to the second chamber through the filter thereby collecting the particles in the first chamber.

10. A washer according to claim 9 further comprising a second filter disposed between the wash chamber and the sump.

11. A washer according to claim 8 further comprising a filter disposed between the wash chamber and the sump.

12. A washer according to claim 1 further comprising a drain opening disposed in the first chamber.

13. A washer according to claim 8 further comprising a drain opening disposed in the first chamber.

14. A washer according to claim 8 further comprising a rack adapted for holding articles in the wash chamber and a spray arm adapted for spraying liquid moved by the pump onto the articles.

* * * * *